United States Patent [19]

Pai et al.

[11] Patent Number: 4,849,315

[45] Date of Patent: Jul. 18, 1989

[54] PROCESSES FOR RESTORING HYDROGENATED AND HALOGENATED AMORPHOUS SILICON IMAGING MEMBERS

[75] Inventors: Damodar M. Pai, Fairport; Santokh S. Badesha, Pittsford, both of N.Y.

[73] Assignee: Xerox Corporation, Stamford, Conn.

[21] Appl. No.: 75,163

[22] Filed: Jul. 20, 1987

Related U.S. Application Data

[63] Continuation-in-part of Ser. No. 573,987, Jan. 26, 1984, abandoned.

[30] Foreign Application Priority Data

Jan. 21, 1985 [JP] Japan ..... 60-8946

[51] Int. Cl.[4] ..... G03G 5/085

[52] U.S. Cl. ..... 430/84; 430/95; 430/130

[58] Field of Search ..... 156/636, 638, 653, 657; 134/2, 3, 28, 30, 37; 430/84, 95, 130

[56] References Cited

U.S. PATENT DOCUMENTS

| | | | |
|---|---|---|---|
| 4,342,044 | 7/1982 | Oushinsky et al. | 430/84 |
| 4,356,246 | 10/1982 | Tabei et al. | 430/136 |
| 4,380,490 | 4/1983 | Aspnes et al. | 134/3 |
| 4,382,071 | 5/1983 | Otsuka et al. | 423/341 |
| 4,394,426 | 7/1983 | Shimizu et al. | 430/65 |
| 4,464,451 | 8/1984 | Shirai et al. | 430/65 |
| 4,468,443 | 8/1984 | Shimizu et al. | 430/65 |
| 4,624,906 | 11/1986 | Kawamura et al. | 430/84 |

*Primary Examiner*—John L. Goodrow

*Attorney, Agent, or Firm*—E. O. Palazzo

[57] ABSTRACT

A process for restoring imaging members, which comprises (1) providing a hydrogenated or halogenated amorphous silicon imaging member subsequent to its utilization in and removal from an electrophotographic imaging apparatus; and (2) contacting this member with a fluorine containing composition for an effective time period thereby resulting in an imaging member that when incorporated into an electrophotographic imaging apparatus enables the achievement of images with substantially no white spots as compared to the removed member.

19 Claims, No Drawings

PROCESSES FOR RESTORING HYDROGENATED AND HALOGENATED AMORPHOUS SILICON IMAGING MEMBERS

This application is a continuation-in-part of copending U.S. Ser. No. 573,987, now abandoned filed Jan. 26, 1984, and entitled Process For Post Fabrication Treatment of Hydrogenated Amorphous Silicon Compositions. The disclosure of the aforementioned application is totally incorporated herein by reference.

BACKGROUND OF THE INVENTION

This invention is generally directed to processes for treating amorphous silicon, and more specifically, the present invention is directed to a simple direct, economically attractive process for restoring amorphous silicon photoconductive substances with fluorine containing compositions. In one embodiment, the present invention is directed to a process for treating virgin amorphous silicon photoconductive substances with fluorine containing compositions, such as hydrofluoric acid, thereby increasing the charge acceptance of these substances. Also, in accordance with the process of the present invention the charge acceptance of amorphous silicon photoconductors can be increased subsequent to their use in an imaging apparatus. Moreover, in accordance with the process of the present invention amorphous silicon containing undesirable invisible latent scratches on the surface thereof can be treated with fluorine containing substances for the purpose of eliminating the print out of these scratches. Further, in accordance with the process of the present invention image defects which appear as white spots obtained with virgin electrophotographic amorphous silicon devices can be eliminated. Additionally, by treating amorphous silicon in accordance with the process described hereinafter aging of stored photoconductive drums, which translates into loss of image resolution, can be prevented.

In one important embodiment of the present invention, the process comprises restoring hydrogenated or halogenated amorphous silicon imaging members by contacting these members with vapors of hydrogen fluoride for a period of from about 1 minute to about 240 minutes thereby resulting in a member that when reincorporated into electrophotographic imaging devices enables the achievement of images of increased resolution with substantially no white spots as compared to the member prior to treatment, which is substantially unusable.

Amorphous silicon photoconductors treated in accordance with the process of the present invention are useful as photoconductive imaging members in an electrophotographic imaging apparatus wherein, for example, electrostatic latent images formed on the surface thereof are developed with toner particles, transferred to a suitable substrate such as paper, and subsequently optionally permanently affixed thereto by heat for example.

Electrophotographic imaging systems, particularly xerographic imaging systems, are well known, and are extensively described in the prior art. In these systems, generally a photoresponsive or photoconductor material is selected for forming the latent electrostatic image thereon. This photoreceptor is generally comprised of a conductive substrate containing on its surface a layer of photoconductive material, and in many instances a thin barrier layer is situated between the substrate and the photoconductive layer to prevent charge injection from the substrate as injection would adversely effect the quality of the resulting image. Examples of known useful photoconductive materials include amorphous selenium, alloys of selenium such as selenium tellurium, selenium arsenic, and the like. Additionally, there can be selected as the photoresponsive imaging member various organic photoconductive materials, including, for example, complexes of trinitrofluorenone and polyvinyl carbazole. Recently, there have been disclosed layered organic photoresponsive devices containing separate charge transport and photogenerating layers. Examples of charge transport layers include various diamines, while useful photogenerating compositions include trigonal selenium, metal and metal-free phthalocyanines, vanadyl phthalocyanines, and the like.

Also known are amorphous silicon photoconductors, reference for example U.S. Pat. No. 4,265,991. There is disclosed in this patent an electrophotographic photosensitive member containing a substrate, a barrier layer, and a photoconductive overlayer of amorphous silicon containing 10 to 40 atomic percent of hydrogen, and having a thickness of 5 to 80 microns. Additionally, this patent describes several processes for preparing amorphous silicon. In one process, there is prepared, according to the teachings of this patent, an electrophotographic sensitive member by heating the member contained in a chamber to a temperature of 50° C. to 350° C., introducing a gas containing silicon and hydrogen atoms into the chamber, causing an electrical discharge in the space of the chamber, followed by depositing amorphous silicon on an electrophotographic substrate at a rate of 0.5 to 100 Angstroms per second. The charge acceptance of these devices is found to be limited by the surface conditions. Further, in many instances as a result of corona interaction with the surfaces of the devices prepared in accordance with the process of this patient, the surface conductivity undesirably increases resulting in a loss of image resolution, and a decrease in image density within less than about 1,000 imaging cycles. Accordingly, while the amorphous silicon photosensitive devices of the '991 patent are useful, their selection as a commercial device for a number of imaging cycles is not readily achievable.

Disclosed in U.S. Pat. No. 4,357,179, issued Nov. 2, 1982, is a method for preparing devices containing high density amorphous silicon or germanium wherein with respect to the amorphous silicon, p-doping or b-doping can be affected with dopants such as phosphorous or boron, reference the disclosure in column 5, beginning at line 44, and specifically at lines 55 to 65.

Also, in U.S. Pat. No. 4,237,150, issued Dec. 2, 1980, there is disclosed a method for preparing hydrogenated amorphous silicon wherein ammonia is introduced into a reaction chamber with a silane gas for the purpose of enhancing the photoconductivity of the resulting hydrogenated amorphous silicon films, reference the disclosure in column 1, beginning at around line 20.

Further, U.S. Pat. No. 4,237,151, issued Dec. 2, 1980, discloses the preparation of hydrogenated amorphous silicon substances by thermally decomposing silane or other gases at elevated temperatures and under specific vacuum conditions wherein a gaseous mixture of atomic hydrogen and atomic silicon result, followed by depositing this mixture onto a substrate situated outside a heated tungsten tube wherein a film of hydrogenated amorphous silicon is formed on the substrate. In column 4, beginning at line 58, it is indicated that conventional doping gases can be added to the silane if desired.

Furthermore, U.S. Pat. No. 4,356,246, issued Oct. 26, 1982, describes a specific noncrystalline silicon powder having excellent photoconductivity comprised of silicon and hydrogen, which powder exhibits specific characteristics such as an infrared absorption spectrum characterized by absorption peeks centered about certain areas, reference the Abstract of the Disclosure. There is disclosed in column 5, beginning at line 41, that in addition to hydrogen other elements such as oxygen, fluorine, chlorine, bromine, iodine, phosphorous, boron, solely or in the form of a combination, may be contained in the amorphous silicon particles for the purpose of controlling the electrical conductivity thereof.

Additionally, U.S. Pat. No. 4,361,638, issed Nov. 30, 1982, discloses a light sensitive electrophotographic element including a photoconductive layer comprised of amorphous silicon and a carbon based material doped with hydrogen and fluorine, reference the disclosure in column 4, beginning at line 3.

Additionally, U.S. Pat. No. 4,365,013, issued Dec. 21, 1982, discloses an amorphous silicon layer, which apparently can be rendered highly photoconductive by doping with hydrogen, or by doping with impurities, reference the disclosure in column 2, beginning at line 46. Doping materials disclosed include halogens such as fluorine, chlorine, bromine and iodine, reference the disclosure in column 2, beginning at line 57.

Other references of interest include U.S. Pat. Nos. 4,342,044; 4,394,426; 4,468,443 and 4,490,208. In the '044 patent, reference column 4, beginning at line 54, and particularly at line 65, there is disclosed that the nonoptimum spectral response of the prior art amorphous silicon photoresponsive devices is overcome by adding one or more band gap adjusting elements to the amorphous photoresponsive alloy. More specifically, as stated at line 65, "The amorphous alloy incorporates at least one density of states reducing element, fluorine. The compensating or altering element, fluorine or elements, can be added during deposition or thereafter.". Also, disclosed in the '208 patent are methods of obtaining thin films of silicon by doping a p or n type thin film of silicon with an impurity element under a plasma discharge of gas of at least one element selected from among fluorine, chlorine, bromine, iodine, and hydrogen, reference column 1, lines 51 to 63. In the '426 patent, there is disclosed a photoconductive member containing amorphous silicon atoms as a matrix, hydrogen or halogen atoms; and as an intermediate layer an amorphous material containing, for example, silicon atoms and nitrogen atoms.

Additionally, described in U.S. Pat. No. 4,634,647, the disclosure of which is totally incorporated herein by reference, are processes for preparing amorphous silicon, which is useful for incorporation into an electrophotographic imaging apparatus, wherein images of high resolution can be obtained for a number of imaging cycles. This process involves simultaneously treating amorphous silicon with dopants such as boron and phosphorous.

Recently, substantial interest has been directed to obtaining amorphous silicon photoreceptor materials since they possess a number of advantages in comparison to, for example, amorphous selenium based materials in that amorphous silicon is of extreme hardness and will not crystallize over extended time periods even at temperatures as high as several hundred degrees Centigrade. Additionally, amorphous silicon photoreceptor materials have excellent photoelectric properties, high absorption coefficients through the visible region, and are relatively low in useful life cost in comparison to selenium photoconductors. Moreover, amorphous silicon photoreceptors are capable of ambipolarity as they can be xerographically charged, and discharged either positively or negatively in various imaging systems. Furthermore, amorphous silicon can be modified by adding various dopants thereto such as boron and phosphorous, enabling this material to function as a p or n type semiconductor device; and amorphous silicon may be alloyed with other materials including germanium and tin for the purpose of providing a material which will be photosensitive in the infrared region of the spectrum. Moreover, amorphous silicon materials are inert and nontoxic rendering them highly desirable as a photoconductive imaging member.

While processes are known for preparing amorphous silicon, in most instances these processes result in members which, after repeated usage in electrophotographic imaging devices, have decreased charge acceptance causing the resulting images to be of poor density. While it is not desired to be limited by theory, it is believed that as a result of a continuous mechanical interaction of developer carrier beads with the surface of the amorphous silicon, the silicon-hydrogen, and/or silicon-silicon bonds are broken, and in the presence of water vapor are reformed into silicon-hydroxy type bonds. The charge acceptance of these devices, which is limited by the surface conditions, decreases as a result of this mechanical interaction causing an undesirable reduction in the density of the images produced. Further, the mechanical damage caused by the developer beads during the development step lowers the charge acceptance of the entire amorphous silicon photoresponsive device or drum, and causes a corresponding decrease in the density of the total image.

Another type of mechanical damage observable with many hydrogenated or halogenated amorphous silicon imaging members is confined to small isolated areas of the surface, this damage generally being referred to as scratches. These scratches are caused, for example, during xerographic imaging processes wherein the amorphous silicon photoconductor is subjected to cleaning with wiper blades. Furthermore, interaction of the amorphous silicon with isolated carrier particles contained in the developer mixture can cause scratches. Additionally, these scratches can be generated during the handling of the amorphous silicon drum while it is being manufactured, and during the positioning of this drum within the machine involved. These latent scratches, which are not visible, damage the surface of the amorphous silicon causing a reduction in the charge acceptance thereof, and a print out of the scratches. Thus, subsequent to a minimum number of imaging cycles mechanical interaction of amorphous silicon member with carrier beads causes a reduction in image density wherein scratches print out. Eventually, the amorphous silicon photoreceptor, which was initially selected for its durability, may no longer be useful, and thus is discarded.

Additionally, it is believed that the degradation of the electrophotographic performance of amorphous silicon is caused by the sensitivity of the silicon imaging device to chemical alterations by exposure to a corona atmosphere, especially at high humidities. These sensitivities create fundamental limitations for the practical use of devices wherein the exposed surface contains substantially amorphous silicon. While this problem can be minimized by encapsulating the silicon with a chemically passive hard overcoating of amorphous silicon nitride, amorphous silicon carbide, or amorphous carbon, such devices when incorporated into xerographic imaging systems can result in image blurring and very rapid image deletion in a few imaging cycles, typically less than about ten. Furthermore, in these overcoated devices poor image quality with cycling is caused by an increase in the surface conductivity of the underlying amorphous silicon layer, rather than to abrasion or chemical interaction as occurs with amorphous silicon containing no protective overcoating layer. This conductivity increase is induced by the electric field existing at the surface of the overcoated device, similar to the effect resulting from the field effect in well known metal-insulator-semiconductor devices, causing a lateral spreading of the photogenerated charges in the fringe electric fields associated with line or edge images projected on the photoreceptor surface thereby resulting in undesirable image blurring and image deletion.

Moreover, certain freshly prepared amorphous silicon imaging members possess small defect regions referred to as white spots that accept no charge. White spots, which are generated during duplication of originals with dark solid areas, are most likely caused by structural defects in the amorphous silicon. Furthermore, it is known that amorphous silicon photoreceptors undesirably age with storage, thus although fair resolution of the images obtained with such devices is observed within a short period subsequent to fabrication, the devices when stored for a few months generate images with a loss of resolution. It is believed that these changes are caused by chemical modifications of the amorphous silicon surface as a result, for example, of the interaction of the amorphous silicon with its ambient surroundings.

Accordingly, there continues to be a need for obtaining amorphous silicon imaging members which can be repeatedly used in a number of imaging cycles. Additionally, there continues to be a need for processes for treating amorphous silicon photoconductive materials for the purpose of increasing charge acceptance and resolution thereof, and eliminating surface scratches and white spots therefrom. Moreover, there continues to be a need for restored amorphous silicon photoconductive materials thereby resulting in the elimination of surface scratches and an increase in charge acceptance for these materials. Further, there continues to be a need for processes wherein virgin unused amorphous silicon photoconductive substances can be treated primarily for the purpose of increasing the charge acceptance thereof. Also, there continues to be a need for direct economical processes for restoring amorphous silicon imaging members, which subsequent to restoration can be selected for incorporation into an electrophotographic imaging system, and wherein there results increased charge acceptance allowing the restored member to be useful for a substantial number of imaging cycles without causing a degradation in image quality, and specifically without resulting in images of low density and poor resolution. Furthermore, there continues to be a need for processes to refurbish or rejuvenate amorphous silicon drums that show loss of density and scratch print out subsequent to use in an imaging apparatus.

SUMMARY OF THE INVENTION

It is therefore an object of the present invention to provide processes for restoring amorphous silicon imaging members.

In yet another object of the present invention there are provided improved processes for restoring amorphous silicon substances with fluorine containing compositions.

In a further object of the present invention there are provided improved direct processes for restoring amorphous silicon photoconductive materials for the purpose of increasing the charge acceptance thereof.

A further specific object of the present invention resides in an improved process for restoring amorphous silicon photoconductive materials with fluorine containing substances, such as hydrofluoric acid, for the purpose of eliminating latent surface scratches thereon.

In a further object of the present invention there are provided processes for treating virgin amorphous silicon photoconductive materials for the purpose of increasing the charge acceptance thereof.

In yet another object of the present invention there are provided processes for restoring virgin amorphous silicon photoconductive materials wherein there results increased image resolution when these materials are incorporated in xerographic imaging apparatus.

In a further object of the present invention there are provided processes for treating virgin amorphous silicon photoconductive materials for the primary purpose of eliminating image defects, including known white spots.

Additionally, in another object of the present invention there are provided processes for restoring hydrogenated or halogenated amorphous silicon imaging members subsequent to their utilization in an electrophotographic imaging apparatus by subjecting the aforementioned used members to hydrogen fluoride vapors for a sufficient period of time to enable a member that can be subsequently reutilized in electrophotographic imaging devices, and wherein there is obtained the achievement of images of increased resolution with substantially no white spots as compared to the unrestored member.

These and other objects of the present invention are accomplished by the provision of an improved simple, direct process for restoring amorphous silicon photoconductive members by contacting these members with fluorine containing compositions. More specifically, in one embodiment the present invention is directed to an improved process, which comprises (1) providing an amorphous silicon photoconductive substance, and (2) contacting the substance with compositions containing fluorine for a sufficient period of time to enable an increase in the charge acceptance of the photoconductive substance, and/or the elimination of surface scratches contained thereon.

In one specific embodiment of the present invention there is provided an improved process for treating amorphous silicion photoconductive materials, which comprises (1) providing a virgin unused amorphous silicon photoconductive substance, and (2) contacting this substance with vapors generated from hydrofluoric acid for a period of time of from about one minute to about 240 minutes, and preferably from about 10 minutes to about 60 minutes, wherein there results an amorphous silicon photoconductor which has increased charge acceptance and resolution as compared to amorphous silicon not treated with hydrofluoric acid vapors.

In a further specific embodiment of the present invention, there is provided an improved process for restoring hydrogenated or halogenated amorphous silicon imaging members, which comprises (1) providing a hydrogenated or halogenated amorphous silicon photoconductive member subsequent to its utilization in and removal from an electrophotographic imaging apparatus, and (2) contacting this member with vapors generated from hydrofluoric acid for a period of time of from about one minute to about 240 minutes, and preferably from about 15 minutes to about 60 minutes wherein the charge acceptance of the removed member has increased, and/or surface scratches contained therein have been substantially eliminated.

In another specific preferred embodiment of the present invention, there is provided an improved process for restoring hydrogenated or halogenated amorphous silicon photoconductive members comprising providing an amorphous silicon photoconductive substance, contacting this substance with vapors generated from hydrofluoric acid for a period of time of from about one minute to about 240 minutes, and preferably from about 10 minutes to about 60 minutes.

Also, in yet another embodiment, the present invention is directed to a process for restoring imaging members, which comprises (1) providing a hydrogenated or halogenated amorphous silicon imaging member subsequent to its utilization in and removal from an electrophotographic imaging apparatus; and (2) contacting this member with a fluorine containing composition for an effective time period thereby resulting in an imaging member that when incorporated into an electrophotographic imaging apparatus enables the achievement of images with substantially no white spots as compared to the removed member.

Illustrative examples of fluorine containing substances that can be selected for the process of the present invention include hydrofluoric acid, hexafluorides, and the like with hydrofluoric acid being preferred. However, it is believed that numerous other substances can be selected providing they function as a fluorinating agent, and achieve the objectives of the present invention.

The amount of fluorinating agent selected is dependent on many factors including, for example, the distance that the amorphous silicon photoreceptor is from the liquid level of a container with the source of fluorine, however, generally from about 100 millimeters to about $10^6$ milliliters, and preferably from about $10^3$ milliliters to about $10^4$ milliliters of fluorinating substance are selected. Also, the amorphous silicon photoconductive member being restored can be dispersed in the fluorine containing solution, or is preferably contacted with the vapors of such solutions by, for example, rotating the member above and in close proximity to the fluorine containing solution. Rotation is affected at from about 0.2 revolutions per minute to 60 revolutions per minute, and preferably from about 10 revolutions per minute to 30 revolutions per minute.

When dispersed in the fluorine containing solution, the amorphous silicon photoconductor imaging member is allowed to remain therein for a period of from about 1 minute to about 240 minutes, and preferably for a period of from about 10 minutes to about 60 minutes. By solution in accordance with the process of the present invention is meant a water solution of fluorine containing substance, such as hydrofluoric acid, which contains from about 25 percent by weight to about 60 percent by weight of hydrogen fluoride, and from about 75 percent by weight to about 40 percent by weight of water.

The results of the treatment or restoration can be verified by analytical methods including Secondary Ion Mass Spectrometry (SIMS) and Electron Spectroscopy for Chemical Analysis (ESCA). These techniques revealed higher levels of fluorine on the exposed amorphous silicon regions as compared to unexposed or virgin amorphous silicon devices. Also, the charge acceptance of the amorphous silicon photoconductive member treated or restored in accordance with the process of the present invention has about doubled from, for example, 200 volts to 400 volts for virgin devices; and has increased more than five times, 80 to 400 volts, for devices subsequent to their use in, and removal from an imaging apparatus.

Charge acceptance of the amorphous silicon photoconductive substance is directly related to the quality of the images obtained. Thus, for example, when the charge acceptance of untreated amorphous silicon decreases to about 110 volts from 200 volts after about 10,000 imaging cycles the density of the resulting image is unacceptable in that it decreases from about 1.2 to about 0.7. Eventually, the voltage decrease of the untreated amorphous silicon is significant to the extent that the density of the resulting images are close to zero, and thus in some instances are unreadable.

By charge acceptance in accordance with the process of the present invention is meant the measured potential on the amorphous silicon photoreceptor immediately subsequent to charging. Charge acceptance can be determined by a number of known methods including a measurement of the surface potential of the amorphous silicon with a capacitively coupled probe mounted in close proximity to the charging corotron. Generally, a charge acceptance of from about 200 volts to about 350 volts is desired for a ten micron thick amorphous silicon, and further it is important that this charge acceptance remain constant for over 100,000 imaging cycles.

Subsequent to treatment or restoration in accordance with the process of the present invention, the amorphous silicon photoconductive substances are generally washed with inert materials, such as water, with about 10,000 milliliters to about 50,000 milliliters of water being used, and allowed to dry. Other washing substances can be selected providing the objectives of the present invention are achieved.

Examples of amorphous silicon imaging members that can be treated or restored with the process illustrated herein include hydrogenated and halogenated members containing from about 10 to about 50 atomic percent of hydrogen or halogen, including chlorine, fluorine or mixtures thereof. Accordingly, thus with the process of the present invention hydrogenated or halogenated, including fluorinated, imaging members subsequent to their utilization in an electrophotographic imaging apparatus can be restored, and subsequently repeatedly used for a number of imaging cycles in said apparatus by subjecting the used member to hydrogen fluoride vapors. Generally, thus many hydrogenated or halogenated amorphous silicon imaging members are initially useful for about 10,000 copies in an electrophotographic imaging device at which time they must be replaced since images of decreased resolution, for example, result. Rather than discarding these members as is presently the practice, they can be restored and reused by following the process as illustrated herein wherein these members are exposed, for example, to hydrogen fluoride vapors for an effective time period. The restored members, which can then be reincorporated into the imaging apparatus, enable the achievement of images of excellent resolution with substantially no white spots as compared to the unrestored member, that is the member that has been utilized for 10,000 copies.

Photoresponsive imaging members treated and/or restored in accordance with the process of the present invention can be incorporated into various imaging systems, particularly xerographic imaging systems. In these systems, latent electrostatic latent images are formed on the devices involved, followed by developing the images with known developer compositions, subsequently transferring the image to a suitable substrate, and optionally permanently affixing the image thereto. The amorphous silicon photoconductor devices selected for these imaging systems, subsequent to treatment or restoration in accordance with the process of the present invention, are useful for generating images of high resolution, and high density for an extended number of imaging cycles. Further, subsequent to treatment in accordance with the process of the present invention the undesirable white spots caused during fabrication are eliminated thereby providing for images of high quality, and excellent resolution. Also, subsequent to treatment in accordance with the process described herein, the aging of the amorphous silicon as described hereinbefore, which appears as a loss of image resolution, is substantially eliminated.

While it is not desired to be limited by theory, it is believed that untreated amorphous silicon when subjected to an electrophotographic enviroment causes the silicon hydrogen bonds to fracture thus creating surface scratches thereon, and decreasing the charge acceptance of such devices. More specifically, it is believed as indicated hereinbefore that the fractured bonds in the presence of water vapor silicon hydroxide bonds thus altering the characteristics of the surface. In any event, surface abrasion causes the formation of conductive states on the surface of the amorphous silicon, and during charging this results in a reduction in charge acceptance.

This invention will now be described in detail with respect to specific preferred embodiments thereof, it being understood that these examples are intended to be illustrative only. The invention is not intended to be limited to the materials, conditions or process parameters recited herein. All parts and percentages are by weight unless otherwise indicated.

EXAMPLE I

In a plasma reactor, a boron doped hydrogenated amorphous silicon drum was fabricated as follows: A 1,000 Angstrom thick blocking interface layer of 100 parts per million (ppm) of a boron doped hydrogenated, 25 atomic percent of hydrogen, amorphous silicon material, A-Si:H, was first formed by flowing into a reactor, reference U.S. Pat. No. 4,513,022, the disclosure of which is totally incorporated herein by reference, 200 sccm (standard cubic centimeters per minute) of silane gas mixed with 100 parts per million of diborane. The plasma pressure was maintained at 500 microns and $13.6\times10^6$ cycles of radio frequency (rf) power of 30 watts was applied between a rotating aluminum drum maintained at a temperature of 230° C., and a concentric counterelectrode contained in the reactor. Following deposition of the interface on the aluminum substrate, a 30 micron thick layer of amorphous silicon, A-Si:H containing 10 ppm boron was formed thereover as follows: 180 sccm of silane gas and 20 sccm of silane gas containing 100 ppm diborane were passed through the reactor. The plasma pressure was set at 500 microns and the rf power at 30 watts. A 30 micron thick layer containing 10 ppm boron doped A-Si:H was formed in 17 hours of plasma depositions over the interface.

EXAMPLE II

The electrophotographic properties of the layered drum device as prepared in Example I were measured in a scanner while the drum was rotating at 20 revolutions per minute. Also, the drum was positively charged by a 10 inch wide corotron in a constant current set up. Specifically, with 30 microamps charging current, the drum charge acceptance was as measured in the scanner found to be 200, 130 and 90 volts, respectively, at times of t=0.19, 0.42 and 1.12 seconds, respectively, following charging. The device had good sensitivity to light and could be discharged completely with light of 8 ergs/cm$^2$.

The drum was then inserted into a Xerox Corporation 3100® imaging apparatus, and dark dustings of adequate densities were prepared. The dark dustings, printing following charging with no exposure, indicated considerable white spots evidencing defects in the amorphous silicon film.

EXAMPLE III

The silicon drum as prepared in Example I was divided into four segments along its length, properly identified as A, B, C and D. The first and third segments were protected by Mylar tape fastened around the circumference of the drum. Thereafter, the drum was subjected to surface interaction with bare sponge iron beads in a wear test fixture, an aging accelerated test to determine the effect of producing 2,400 copies on the drum. After 2 hours in the wear test fixture, the Mylar tape from sections A and B were removed, and the drum was inserted into the 3100® copying machine of Example II. Dark dustings, printing following charging with no exposure, showed that the print density of protected regions A and C were uneffected. The print density in regions B and D was considerably reduced from 1.2 to 0.7. The drum was tested in a scanner, and it was found that at 30 microamps of charging current the potential of regions A and C were 200, 130 and 90 volts, respectively, at t=0.19, 0.42 and 1.12 seconds, repsectively, thus the potentials in protected regions A and C remained unchanged. The potentials of regions B and D were 110, 45 and 20 volts, respectively, at t=0.19, 0.42 and 1.12 seconds, respectively, after charging. Therefore, accelerated aging has dramatically reduced the charge acceptance of regions B and D.

EXAMPLE IV

Regions C (virgin and tape removed), and D (aged) segments of the drum device of Example III were then exposed to HF vapor by rotating the drum over a beaker containing an HF solution, about 60 percent of water, and about 40 percent of hydrofluoric acid. Regions A and B were protected by Mylar tape to minimize the exposure of these regions to HF. After 1 hour exposure to HF, there resulted on the drum virgin region A, aged segment B, virgin segment C exposed to HF, and aged segment D exposed to HF vapor. The Mylar tape was then removed from segments A and C.

On print testing, the dark dustings showed that the only region with loss of image density was B. The loss of image density of segment D on aging was restored by HF vapor treatment. The white spots observed in the dark dusting of the virgin drum were mostly eliminated in regions exposed to HF vapor.

On measuring the resultant drum in a scanner, the followig potentials were obtained in volts at the time indicated in seconds:

| Segment | Condition | V at 0.19 Sec. | V at 0.42 Sec. | V at 1.2 Sec. |
|---|---|---|---|---|
| A | Virgin | 200 | 130 | 90 |
| B | Aged | 110 | 45 | 20 |
| C | Virgin and HF Exosed | 230 | 150 | 100 |
| D | Aged and HF Exposed | 210 | 130 | 100 |

The charge acceptance of the virgin area has thus been improved by exposure to HF vapor, and the loss of charge acceptance of the aged area has been restored by exposure to HF vapor. The print defects (white spots) were mostly eliminated by HF treatment as determined by visual observation.

EXAMPLE V

Images of resolution targets were prepared on the amorphous silicon device as prepared in accordance with the process of Example IV. Visual observation indicated the resolution of the HF exposed regions were far superior to that of the virgin region A as there were less white spots and better resolution in regions C and D. The amorphous silicon drum was then stored in the dark under ambient conditions for 10 months, and images of resolution targets were prepared on the stored amorphous silicon drum. Visual observation indicated that the resolution of virgin region A had deteriorated in that images obtained therefrom were blurry and smudged. In contrast, images generated and developed on the stored amorphous silicon photoreceptor in the regions which had been exposed to HF vapor indicated no loss of image resolution in that images of high quality and excellent resolution were obtained.

EXAMPLE VI

A 2 inch×2 inch sample of an imaging member comprised of an aluminum substrate with a thickness of 0.5 inch, and deposited thereover hydrogenated amorphous silicon with 25 atomic percent of hydrogen, which was doped with 10 parts per million of boron, was scanned on a flat plate scanner by traversing the sample under a positive corona wire maintained at 7,000 volts. Thereafter, the charge acceptance across the sample was determined to be 475 volts as measured by a capacitively coupled probe. Subsequently, half of the sample was abraided by 6 light hand rubbings of the aforementioned imaging member with emery paper, which abrasion represents the mechanical wear that the imaging member would undergo in an electrophotographic imaging machine due to developer and cleaning system interactions. Both halves of the imaging member sample were then scanned a second time, and the charge acceptance of the virgin unabraided portion of the imaging member was 475 volts, that is it remained unchanged whereas the charge acceptance of the abraided portion of the aforementioned imaging member decreased dramatically to 100 volts.

EXAMPLE VII

The entire imaging member sample of Example I was then mounted about four inches from a 1,000 cc container containing 100 milliliters of hydrofluoric acid, 30 percent HF, and 70 percent by weight of water. Vapors of HF were emitted from the container, and the entire imaging member was exposed to these vapors for 45 minutes, and thereafter the imaging member was removed. Subsequently, the member was washed with running water for about 5 minutes as a precaution to remove any excess HF. The charge acceptance of the unabraided portion of the imaging member after exposure to HF vapor increased from 475 volts to 530 volts. In addition, the charge acceptance of the abraided portion of the imaging member after HF exposure increased from 100 volts to 530 volts.

EXAMPLE VIII

The entire imaging member of Example VII was then abraided by 6 light hand rubbings with emery paper, and thereafter scanned by repeating the process of Example VI. Both halves of the imaging member possessed reduced charge acceptance, that is a charge acceptance of 100 volts as measured with the capacitively coupled probe. Thereafter, the entire member was exposed to HF vapor by repeating the procedure of Example VII, and the resulting imaging member was scanned. The measured charge acceptance of the entire imaging member was restored to 530 volts.

The aforementioned process was repeated 5 times, and in each instance the charge acceptance of the imaging member subsequent to abrasion by emery paper was 100 volts, and the charge acceptance increased to 530 volts after exposure to HF vapors.

EXAMPLE IX

A 2 inch×2 inch imaging member sample comprised of an aluminum substrate, 0.5 inch in thickness, containing thereover amorphous silicon with 25 atomic percent of a mixture of fluorine and hydrogen, and 10 parts per million of boron was incorporated into a xerographic imaging test fixture; and after 10,000 copies the charge acceptance decreased from 530 to 100 volts as determined by a capacitively coupled probe, reference Example VI, which decrease resulted in images of less density, that is the images were very light in appearance, and thus unacceptable.

This imaging member was then removed from the xerographic test fixture and exposed to HF vapors by repeating the procedure of Example VI, and the charge acceptance thereof increased from 100 volts to 530 volts. This imaging member was then subsequently incorporated into the xerographic imaging test fixture, and there were obtained images of excellent resolution with acceptable densities, and no white spots for 10,000 copies.

Although the invention has been described with reference to specific preferred embodiments, it is not intended to be limited thereto. Rather, those skilled in the art will recognize that variations and modifications may be made therein which are within the spirit of the invention, and within the scope of the following claims.

What is claimed is:

1. A process for restoring imaging members, which comprises (1) providing a hydrogenated or halogenated amorphous silicon imaging member subsequent to its utilization in and removal from an electrophotographic imaging apparatus; and (2) contacting this member with a fluorine containing composition for an effective time period thereby resulting in an imaging member that when incorporated into an electrophotographic imaging apparatus enables the achievement of images with substantially no white spots as compared to the removed member.

2. A process for restoring hydrogenated or halogenated amorphous silicon imaging members, which comprises (1) providing a hydrogenated or halogenated amorphous silicon imaging member subsequent to its utilization in and removal from an electrophotographic imaging member; and (2) subsequently contacting this member with fluorine containing compositions for a period of from about one minute to about 240 minutes thereby enabling the resulting member to be reincorporated into the electrophotographic imaging apparatus and permiting the achievement of images of increased resolution with substantially no white spots as compared to the removed member.

3. A process in accordance with claim 1 wherein the imaging member contains from about 10 to about 40 atomic percent of hydrogen.

4. A process in accordance with claim 2 wherein the imaging member contains from about 10 to about 50 atomic percent of fluorine.

5. A process in accordance with claim 2 wherein the imaging member is subjected to vapors of hydrogen fluoride for a period of from about 10 minutes to about 60 minutes.

6. A process in accordance with claim 2 wherein the imaging member is subjected to vapors of hydrogen fluoride emitted from a solution containing from about 75 percent by weight to about 40 percent by weight of water.

7. A process in accordance with claim 2 wherein subsequent to treatment the imaging member is washed with water.

8. A process in accordance with claim 2 wherein the hydrogenated or halogenated amorphous silicon imaging member is utilized for 10,000 copies prior to restoration.

9. A process in accordance with claim 2 wherein the restoration is accomplished with a hydrogen fluoride solution containing about 60 percent by weight of water and 40 percent by weight of hydrofluoric acid, and the imaging member is subjected to hydrogen fluoride vapors for a period of one hour.

10. A process for restoring halogenated amorphous silicon imaging members which comprises providing a halogenated amorphous silicon member subsequent to its utilization in and removal from an electrophotographic imaging device, and thereafter contacting this member with hydrogen fluoride vapors for a period of from about one minute to about 240 minutes enabling an imaging member that can be reincorporated into an electrophotographic imaging device, and wherein there are obtained images of increased resolution with substantially no white spots as compared to the removed halogenated member.

11. A process in accordance with claim 10 wherein the member is subjected to vapors of hydrogen fluoride for a period of from about 10 minutes to about 60 minutes.

12. A process in accordance with claim 10 wherein there is selected for the formation of said vapors a hydrofluoric solution containing from about 25 percent by weight to about 60 percent by weight of hydrogen fluoride, and from about 75 percent by weight to about 40 percent by weight of water.

13. A process in accordance with claim 10 wherein the imaging member is contacted with hydrofluoride vapors for a period of one hour, and vapors originate from a hydrogen fluoride solution comprised of 60 percent by weight of water and 40 percent by weight of hydrofluoric acid.

14. A method of imaging which comprises providing the restored hydrogenated or halogenated amorphous silicon imaging member of claim 1, subjecting this member to imagewise exposure subsequent to charging, developing the resulting image with toner particles, subequently transferring the image to a suitable substrate, and optionally permanently affixing the image thereto.

15. A method of imaging which comprises providing the restored hydrogenated or halogenated amorphous silicon imaging member of claim 2, subjecting this member to imagewise exposure subsequent to charging, developing the resulting image with toner particles, subequently transferring the image to a suitable substrate, and optionally permanently affixing the image thereto.

16. A method of imaging which comprises providing the restored hydrogenated or halogenated amorphous silicon imaging member of claim 10, subjecting this member to imagewise exposure subsequent to charging, developing the resulting image with toner particles, subequently transferring the image to a suitable substrate, and optionally permanently affixing the image thereto.

17. A method of imaging in accordance with claim 14 wherein the amorphous silicon photoconductive member is treated with hydrofluoric acid.

18. A method of imaging in accordance with claim 14 wherein the charge acceptance of the restored member is increased as compared to the removed member.

19. A process in accordance with claim 14 wherein images with substantially no white spots are obtained with the restored member.

* * * * *